United States Patent [19]

Callegari, Sr. et al.

[11] Patent Number: 4,512,216

[45] Date of Patent: Apr. 23, 1985

[54] PIPE SPINNER

[75] Inventors: Stephen R. Callegari, Sr., Lafayette, La.; Tommie L. Rogers, P.O. Box 30248, Lafayette, La. 70503

[73] Assignee: Tommie Rogers, Lafayette, La.

[21] Appl. No.: 572,289

[22] Filed: Jan. 20, 1984

[51] Int. Cl.[3] ..... B25B 17/00

[52] U.S. Cl. ..... 81/57.17

[58] Field of Search ..... 81/57.17, 57.39

[56] References Cited

U.S. PATENT DOCUMENTS 4,099,429 7/1978 Hauk ..... 81/57.17

4,471,674 9/1984 Doss ..... 81/57.17

*Primary Examiner*—Frederick R. Schmidt

*Assistant Examiner*—J. T. Zatarga

*Attorney, Agent, or Firm*—John D. Jeter

[57] ABSTRACT

A motor driven serpentine chain circulating device for spinning drill pipe into engagement for final tightening by other devices. Jaws are closed and locked to position chain for embracing pipe before the chain tension is applied. Chain tension does not depend upon exact positioning of the jaw closure. Optional sequencing system speeds operation.

22 Claims, 4 Drawing Figures

PIPE SPINNER

RELATED REFERENCES

U.S. Pat. No. 3,906,820
U.S. Pat. No. 4,099,429
U.S. Pat. No. 2,523,159
U.S. Pat. No. 2,784,626

FIELDS OF UTILIZATION

This invention relates to mechanization of the tool joint connection processes for pipe strings used in earth boreholes.

BACKGROUND

Drill strings in earth borehole use are commonly taken apart at threaded connections at ninety-foot, three-joint intervals and usually stand in the derrick as the drill string is removed from the borehole. When the drill string is to be run back into the borehole, the ninety-foot stands are one-by-one attached by threaded connection to the drill string. This is commonly done at intervals to replace dull drill bits or other parts of the downhole assembly.

As drilling proceeds and the hole deepens, the drill string is commonly lengthened by one thirty-foot joint at the time. This joint is normally added to the top end of the string, below the rotational drive device. The rotational drive includes a square or octagonal pipe joint called a Kelly. Each time a single joint of pipe is added to lengthen the drill string, the following sequence takes place: (1) The Kelly is unscrewed from the string; (2) A new joint of drill pipe is positioned and tightened onto the drill string; (3) The Kelly is screwed onto the new joint of drill pipe, and drilling again proceeds. Each threaded drill string tool joint is axially positioned such that the threads to be manipulated are about two feet above the drilling floor before manipulation.

Since the threaded connections of drill string tool joints are tapered somewhat more severely than pipe threads, most of the relative turns between mating threaded elements spin with little torque. The final tightening of a connection or the initial breakout of a connection requires considerable torque. This torque, however, may be required for less than one relative turn of mating connectors. The heavy torque work is commonly done by equipment incapable of rapid spinning of drill pipe.

Historically, the few free turns of threads at each connection have been spun up by a tail chain from a mechanized capstan or "cathead." The tail chain and cathead is a dangerous, time consuming arrangement.

More recently there have been efforts to mechanize the spinning up of the few free turns of the tool joint connection. Spinning devices fall into an all wheel category or into a chain category. This application pertains to the chain type spinner.

Chain type spinners now in use drive the pipe by forcing the chain against the periphery of the pipe in a bight of an incomplete chain loop. The chain is then moved longitudinally in a serpintine, closed path. The chain moves the pipe periphery and hence spins the pipe. This process is best considered with the drawings in hand. At the time of detailed description of drawings herein, a digression will be inserted to differentiate between old and new concepts.

OBJECTS

It is therefore an object of this invention to provide a pipe spinner that requires no forceful movement of the jaws to tension the driving element in contact with the pipe to be spun.

It is another object of this invention to provide a pipe spinner that accomplishes flexible element adjustment to compensate for pipe size variation simultaneously with the tensioning of the flexible element.

It is yet another object of this invention to provide means to control the flexible element tension in proportion to the torque required to spin the pipe.

It is still another object of this invention to provide means to automatically adjust the flexible drive element speed to correspond to pipe spin rate to reduce slippage of the drive element on pipe.

It is yet another object of this invention to provide apparatus to automatically sequence actions of the spinner system to complete a spin operation once the action is initiated.

It is also another object of this invention to provide a flexible drive element with elastomer contact surface to engage the pipe to be spun.

It is a further object of this invention to provide some free motion of the pipe contact rollers to aid in the alignment of the pipe gripping system on the pipe.

These and other objects, advantages, and features of this invention will be apparent to those skilled in the art from a consideration of this specification, including the attached drawings and appended claims.

BRIEF DESCRIPTION OF DRAWINGS

In the drawings, wherein like characters are used throughout to designate like parts.

DETAILED DESCRIPTION OF DRAWINGS

Figure 1:
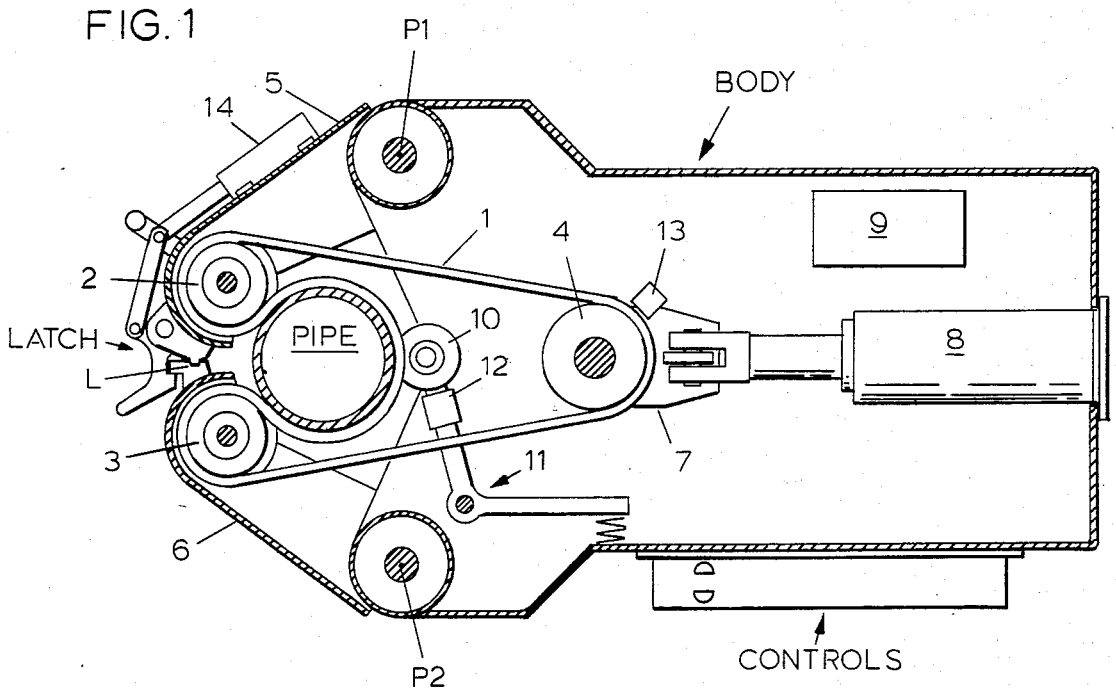
FIG. 1 is a plan view in partial cutaway of the preferred embodiment of the device of this invention.

FIG. 1 is partially cutaway but is in essence the spinner operator's perspective. Description will first encompass those features needed to compare old and new concepts. The spinner body includes jaw attachment pivots P1 and P2. The jaws can swing about the pivots P1 and P2 from the closed position shown to an open position, such that all jaw related structure will be at least spaced enough for the pipe to move away from the spinner to the left. The latch L locks the two jaws at the point L. Points P1, P2, and L outline a force triangle for needed strength.

The chain 1 is a machine power transmission chain which moves in a serpentine path about the guide wheels 2 and 3, and drive sprocket 4. The chain embraces the pipe to be spun in an inverse bight, such that the chain side opposite that contacting rollers contacts the pipe. The pipe spins in a direction opposite that of the rollers.

OLD VS NOVEL

Existing chain type pipe spinners in commercial use have the body and jaws of FIG. 1. The chain orbit is described by the pipe and guide wheels at the end of the arms. The old system provided additional guide wheels rotating about the arm pivots P1 and P2. The old system did not lock the arms together at point L. The old system secured the drive sprocket 4 axis to the body to prevent movement relative to the body. The drive sprocket rotation is driven by power. In the old system, chain tension was provided by massive force cylinders connected by linkage to close jaws 5 and 6. Before closing the jaws to grip a pipe, drive sprocket 4 was adjusted by moving the rotational axis toward or away from the pipe. When the correct chain orbit was established, the jaws would close to nearly touch the guide wheels, after the chain tension was applied. The drive sprocket carrier 7 was locked to the frame at a selected position, usually by clamp bolts.

By locking the jaws instead of the drive sprocket, the novel system serves to eliminate the variables caused by pipe size variation, chain wear, and strain of the frame and arm structure. The large power cylinder can be taken from the jaw closure and used to move the unclamped drive sprocket carrier under force to tension the chain. This eliminates the need for guide rollers at the arm pivot axes. A small jaw closing force is still powered, but by a much smaller cylinder. The rollers at the arm pivot axes were previously used to eliminate the closing effect on the jaws that chain tension delivers in the new arrangement. With the jaws locked together in the new configuration, the complex force vector analysis related to the interaction of chain tension on pipe, rollers, and jaw structure is not critical.

The new concept does not require adjustment within pipe size ranges for which the new concept can be utilized. To spin all practical sizes of pipe related to well drilling and casing, some size ranges may require flexible element length change. To change for pipe size of a different range, the chain length is modified by adding or removing links.

Further detailed description pertains to the concept of this invention. In FIG. 1, jaws 5 and 6 are pivotable on the body at points P1 and P2 to bring a tang and notch L into engagement to form a force triangle of P1, P2, and L. With the pipe to be spun entrapped within a force triangle and embraced by an inverse bight of flexing element 1, tension is applied to the tensioning element by moving drive sprocket 4 away from the pipe. Movement of sprocket 4 is accomplished by force cylinder 8 attached to the body and carrier 7. Pressure required for cylinder 8 is provided by pump 9 operated by air. This pump is a commercially available device. The controls comprise commercially available valving and plumbing. These controls are in common use unless the optional automatic sequencing is used, in which case the control system is subsequently explained. The carrier 7 slides on the body upper surface along guide slots. Drilling rigs have abundant air supplies, and air is delivered to the spinner by a flexible hose (not shown) connected to the spinner plumbing.

Figure 2:
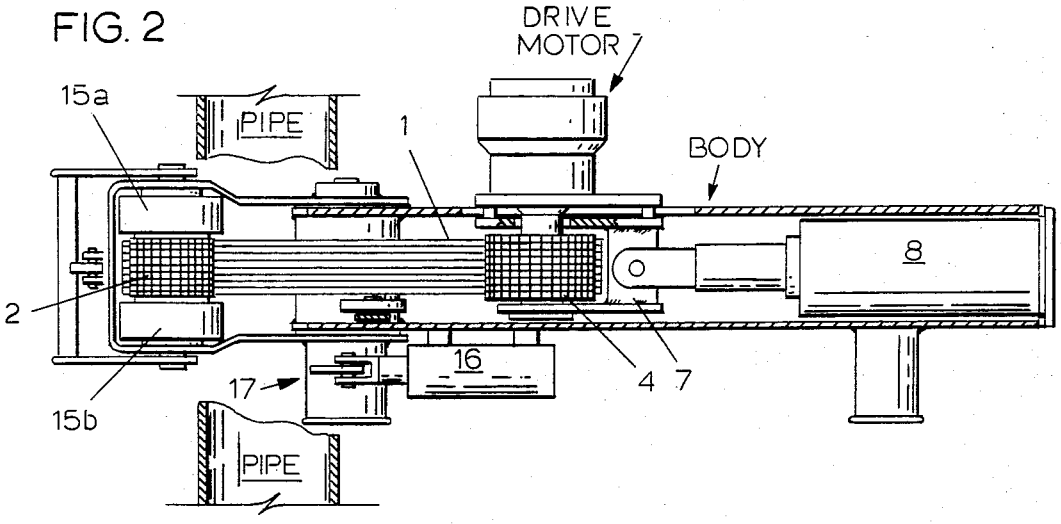
FIG. 2 is a side view, partly cutaway, of the device of FIG. 1.

As shown in FIG. 2, the jaws are closed by cylinder 16 operating through bell crank linkage system 17. Pipe contact wheels 15*a* and 15*b* are shown on the rotational axis of guide wheel 2, which is on the extended portion of jaw 5. Wheel 2 is driven by the flexible element and is rotationally locked to contact wheels 15*a* and 15*b*. A similar set of contact wheels are situated on jaw 6 and similarly related to guide wheel 3 shown in FIG. 1.

The latch may be manually operated but can be operated by power by cylinder 14 attached to jaw 5. Controls may be manually operated for cylinders 14 and 16 from the control package of FIG. 1. Such common control plumbing is not shown in the interest of drawing clarity. If cylinders 14 and 16 are part of the optional automatic sequencing system, the details are reserved for FIG. 3.

Optional sensors 12 and 13 are part of a slip control system for relating flexible element movement to pipe rotation. If the slip limiting feature is used, spring loaded linkage 11 urges wheel 10 into contact with the periphery of the pipe. Sensor 12 detects rotation of wheel 10 by way of a notched wheel surface and hence senses the movement of the pipe periphery. Sensor 13 detects flexible element velocity either from the flexible element irregularities or irregularities in the drive sprocket surface. The two sensors are commercially available magnetic sensors and produce velocity proportional outputs which are compared by a commercially available difference amplifier 35. The amplifier in turn controls a compatible valve 36 regulating the speed of the drive motor. The drive motor so controlled will allow the flexible element to move only slightly faster than the pipe periphery to accomplish slip control.

Figure 4:
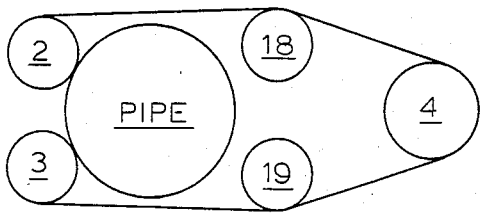
FIG. 4 is a skeleton outline of optional features usable with the device of this invention.

FIG. 4 shows spreader wheels 18 and 19 rotatably mounted on the body (not shown) to guide flexible element 1, so that there is no interference with the flexible element around extra large pipe or casing.

An optional sequencing correlation being used now on prototype devices of this invention involves a linkage between the jaws and the drive wheel carrier. The jaws are spring loaded toward closure and forced open by contact between carrier 7 and linkage 17 of FIG. 2. Cylinder 16 is not needed. No synchronizing adjustments are required, since the jaws are opened on the release of tension from element 1. As element 1 is tensioned, geometry of the orbit and the jaw pivots assures jaw closure.

From the foregoing, it will be seen that this invention is one well adapted to attain all of the ends and objects hereinabove set forth, together with other advantages which are obvious and which are inherent to the apparatus.

SEQUENCING

Figure 3:
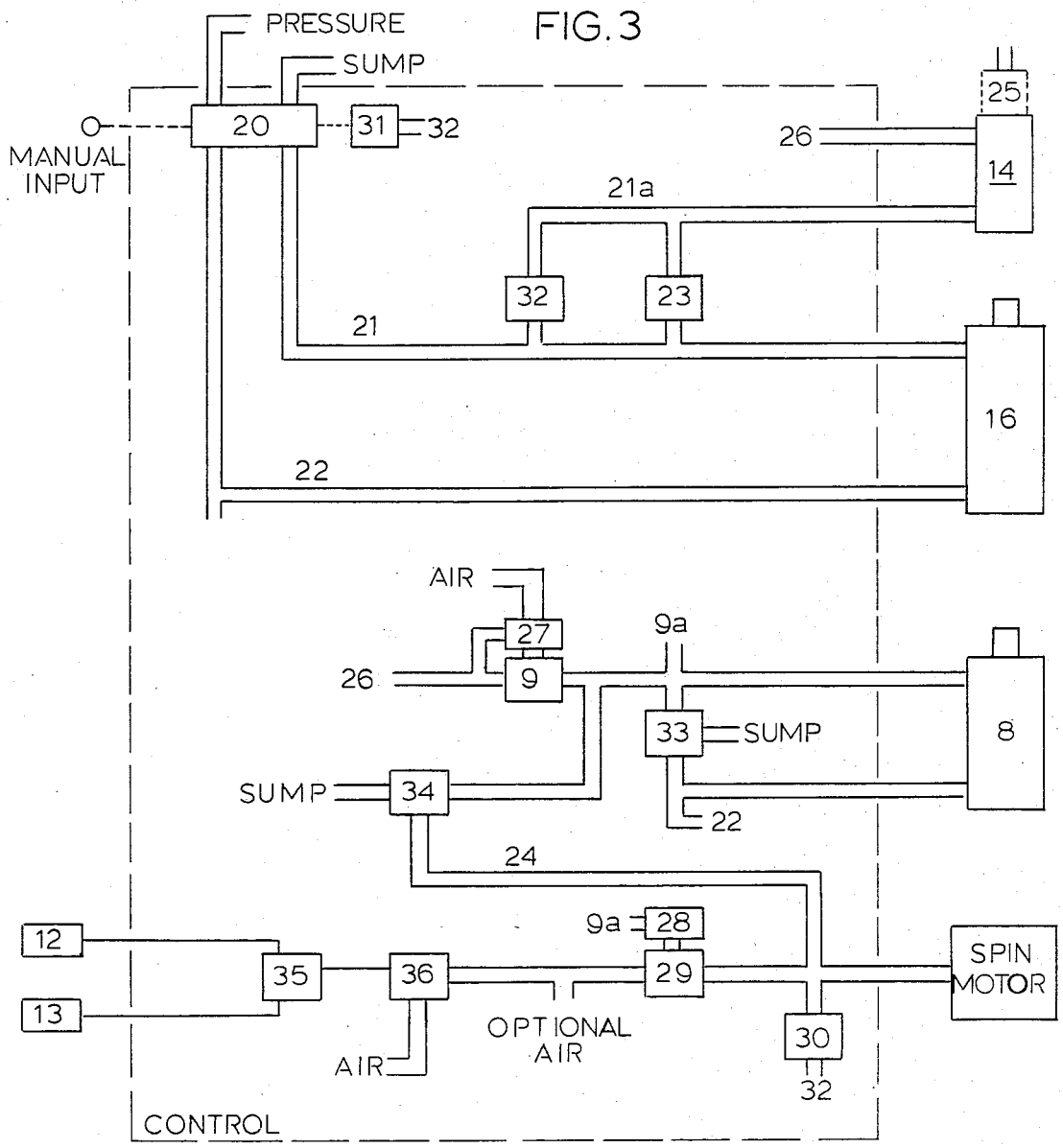
FIG. 3 is a schematic layout of the control circuitry of an optional subsystem for the device of this invention.

FIG. 3 shows the optional sequencing system in absence of the associated structure for clarity.

The initiator manual valve 20 has a pressure port, a sump port, and outlets to circuits 21 and 22. This is a four-way valve. When the valve is operated by the manual input to start the spin sequence, pressure is applied to circuit 21. Circuit 22 is open to the sump outlet. The circuit 21 supplies air under pressure to jaw operating cylinder 16. When the jaws travel to the closed stop, pressure in circuit 21 overcomes relief valve 23 and goes to circuit 21*a* and into the latch closing cylinder 14. The cylinder acts to close the latch (not shown) against bias spring 25. The piston of the latch cylinder passes a port and admits pressure to circuit 26, and enters the pressure booster 9. The presence of pressure at the booster inlet turns on the air to power the booster by way of pilot valve 27. The booster supplies pressure to the tension cylinder 8 which applies force to move the drive sprocket carrier (not shown), which provides tension for the flexible drive element; a chain in this case. When the chain is tensioned to a preselected amount, and resulting higher pressure is impressed on circuit 9*a*, pressure release 28 admits pressure to pilot valve 29 which admits air to the spin motor, which drives the chain drive sprocket to circulate the chain and spin pipe. When the pipe demands sufficient torque, the spin motor back pressure reaches a preselected amount, and pressure relief valve 30 admits air pressure to circuit 32. Pressure is conducted to an air cylinder 31, so sized that it will push the four-way valve 20 to the reverse position. This force can be overcome by considerable hand force on the valve operating lever, but due to this required force, the operator knows he is overriding the sequence termination.

When the four-way valve 20 is reversed, circuit 22 becomes pressurized, and circuit 21 is conveyed to the sump. Pressure is dropped on circuit 21, and circuit 21*a* dumps through check valve 32 to circuit 21. This releases the latch and drops pressure on circuit 26. The booster pump is shut off, and the tension cylinder is released to drop tension on the drive chain. Circuit 22 operates on the jaw cylinder 16, and the jaws open to release the pipe spun. Pilot valve 33, responsive to pressure in circuit 22, opens to dump volume from the tension side of the tension cylinder.

As an optional feature, pilot valve 34 is controlled by back pressure from the spin motor to regulate the oil pressure from the high pressure side of the booster pump. The booster has a limited volume capacity, and the output pressure is controlled by regulated release of volume through valve 34. By choice, valve 34 could regulate the supply pressure to the booster pump to regulate output and control the chain tension to the level needed to avoid slippage. This saves wear and tear on the system. In addition, limiting chain tension allows the rollers and chain to compel alignment of pipe and spinner as first motion occurs when making connections.

Another optional feature allows the chain to slip only a preselected amount on the pipe being spun. Roller 10 is in contact, under spring load, with the pipe to be spun. Sensor 12 senses the movement of the pipe. Sensor 13 senses the motion of the chain. This may also be the drive wheel, if convenient, or any machine element moving in sympathy with the chain. Processor 35 may be a difference amplifier, but there are several systems in the art capable of such functions and capable of operating a compatible valve 36, which controls air supply rate and hence controls spin motor speed. Limiting slippage is necessary to avoid chain damage to pipe, since manual control is too slow. Slippage is often caused by lubricants in the drilling mud. A very slow slippage, however, seems to work off the fluid coating and permit the chain to finally grip the pipe.

It will be understood that certain features and subcombinations are of utility and may be employed without reference to other features and subcombinations. This is contemplated by and is within the scope of the claims.

As many possible embodiments may be made of the apparatus of this invention without departing from the scope thereof, it is to be understood that all matter herein set forth or shown in the accompanying drawings is to be interpreted as illustrative and not in a limiting sense.

The invention having been described, what is claimed is:

1. A powered pipe spinner for joining threaded pipe connections by friction drive of an endless flexible pipe periphery gripping element circulated among drive and guide rollers apparatus comprising:

(a) a body;

(b) opposed pair of jaws movably mounted on said body;

(c) means to synchronize movement of said jaws between a closed and an open position;

(d) means to lock said jaws together in said closed position;

(e) chain guide wheels mounted on said jaws so positioned as to rotate about axes generally parallel with the center axis of pipe to be spun;

(f) a drive wheel carrier movably mounted on said body and means to move said carrier toward and away from the pipe to be spun;

(g) a flexible element drive wheel positioned on said carrier with rotational axis generally parallel the pipe axis situated to tighten and loosen said flexible element by said means to move;

(h) a continuous circulating path for said flexible drive element comprising a positive bight around part of the periphery of said drive wheel, a positive bight around part of the periphery of each of said guide wheels, and a negative bight around part of the periphery of the pipe to be spun;

(i) means to rotate under power said drive wheel mounted on said carrier for sympathetic movement with said drive wheel; and (j) at least two pipe contact wheels mounted on said jaws with axes generally parallel the axis of the pipe to be spun, so situated that when said jaws are in said closed position, the pipe cannot be moved from between said jaws by the force of said negative bight of said flexible element when under tension because of contact of rollers and pipe.

2. The apparatus of claim 1 further providing mutual axes of rotation for said chain guide wheels and said pipe contact wheels on each jaw, and further providing means to rotationally secure said guide wheels to said pipe contact wheels.

3. The apparatus of claim 1 further provided with at least one chain spreader roller mounted on said body to contact said flexible element between said drive wheel and said guide wheels, to prevent said flexible drive element interference for spinning large pipe.

4. The apparatus of claim 1 further provided with a pressure cylinder to move said drive wheel to tension said flexible drive element, and further provided with means to apply pressure to said cylinder proportional to the torque required by said drive wheel to drive said flexible element.

5. The apparatus of claim 1 further provided with means to sense the rotation rate of the pipe being spun, and further provided with means responsive to said sensor to control the rate of movement of said flexible element to yield a flexible element velocity proportional to said sensed pipe rotation rate.

6. The apparatus of claim 1 further provided with means to automatically sequence jaw closing, jaw locking, flexible element tensioning, spinning drive start, spinning drive stop in response to achieved torque level, release of chain tension, unlocking of jaws, and opening jaws once the action is initiated to spin pipe.

7. The apparatus of claim 1 further provided with a flexible continuous drive element comprising an elastomer surface attached to the pipe contact side of said flexible element.

8. The apparatus of claim 3 further provided with means to move said spreader wheel generally lateral to said flexible drive element, and further provided with means to move said spreader wheels in synchronization with said movement of said drive wheel, said simultaneous movement to provide collective action to loosen or tighten said flexible element.

9. The apparatus of claim 2 further provided with limited free rotation of at least one pipe contact wheel to aid in alignment of the spinner on the pipe as said flexible drive element tension is applied.

10. A powered pipe spinner for joining threaded pipe connections by friction drive of an endless flexible pipe periphery gripping element circulated among drive and guide rollers apparatus comprising:

(a) a body;

(b) an opposed pair of elongated jaws, each having a closed and an extended end pivotally mounted in opposition on said body at the close ends;

(c) means mounted on said body and connected to said jaws to move said jaws in synchronization such that said extended ends are moved apart for open and moved together for closed positions;

(d) a pair of flexible element guide wheels mounted one each on said jaws, with rotational axes approximately parallel the axis of pipe to be spun;

(e) a flexible drive element drive wheel mounted for rotation on a movable carrier situated on said body with the axis of rotation approximately parallel the pipe axis;

(f) an elongated closed loop flexible drive element distributed for circulation about a path which wraps partially around each in turn, said drive wheel, one of said guide rollers, and inversely around the periphery of the pipe to be spun, and around the remaining guide wheel and back to said drive wheel, such that the opposite side of said flexing element contacts the pipe from that contacting said wheels, said path causing wheels and pipe to rotate in opposite directions;

(g) pipe contact wheels mounted on said guide wheel axis, at least one on each axial side of said guide wheels, said contact periphery being of such diameter as to contact the pipe such that said flexible element does not touch the pipe at the point of inflection between said path around said guide wheels, and said path around said pipe;

(h) latch means to connect said extended ends of said jaws such that said pipe contact wheels prevent the ejection of the pipe from said inverse bight of said flexing element when said flexible element is under tension;

(i) force cylinder means mounted on said body and connected to said drive wheel carrier to move said carrier toward and away from the pipe centerline to change tension in said flexible drive element; and (j) powered rotary drive means connected to and movable with said drive wheel to power said circulation of said flexible element.

11. The apparatus of claim 10 further provided with interlock means to rotationally lock together said chain guide wheels and their axially associated pipe contact wheels.

12. The apparatus of claim 10 further provided with at least one chain spreader roller mounted on said body to contact said flexible element between said drive wheel and said guide wheels, to prevent said flexible drive element interference for spinning large pipe.

13. The apparatus of claim 10 further provided with a pressure cylinder to move said drive wheel to tension said flexible drive element, and further provided with means to apply pressure to said cylinder proportional to the torque required by said drive wheel to drive said flexible element.

14. The apparatus of claim 10 further provided with means to sense the rotation rate of the pipe being spun, and further provided with means responsive to said sensor to control the rate of movement of said flexible element to yield a flexible element velocity proportional to said sensed pipe rotation rate.

15. The apparatus of claim 10 further provided with means to automatically control at least part of a sequence comprising jaw closing, jaw locking, flexible element tensioning, spinning drive start, spinning drive stop in response to achieved torque level, release of chain tension, unlocking of jaws, and opening of jaws, once the action is initiated to spin pipe.

16. The apparatus of claim 10 further provided with a flexible continuous drive element comprising an elastomer surface attached to the pipe contact side of said flexible element.

17. The apparatus of claim 12 further provided with means to move said spreader wheel generally lateral to said flexible drive element, and further provided with means to move said spreader wheels in synchronization with said movement of said drive wheel, said simultaneous movement to provide collective action to loosen or tighten said flexible element.

18. The apparatus of claim 11 further provided with limited free rotation of at least one pipe contact wheel to aid in alignment of the spinner on the pipe as said flexible drive element tension is applied.

19. The apparatus of claim 10 further provided with connector means to actuate jaw closure with said movement of said carrier, such that release of flexible element tension is accompanied by opening of jaws and further provided by bias means to urge jaws toward closure when said carrier is moved to provide tension to said flexible element.

20. A method for spinning pipe to be connected by threads to a continuing pipe string in earth borehole operations to speed up making and breaking connections at the surface work station, comprising the steps of:

(a) providing an elongated endless flexible drive element having two sides, one side adapted to engage a pipe periphery by friction, the other side adapted to engage driving means by non-slipping engagement surfaces common to machine drives;

(b) forcefully circulating said flexible drive element under longitudinal tension in a path that at least partially wraps the periphery in turn; a drive wheel, a guide wheel adjacent the pipe to be spun, more than half the periphery of the pipe to be spun by an inverse bight, a second guide wheel spaced from the first guide wheel less than the diameter of the pipe, such that the pipe cannot be ejected from said inverse bight and back to said drive wheel;

(c) disposing a pipe to be spun in said inverse bight;

(d) engaging the pipe walls by wheels driven by said guide wheels at the point of inflection of said flexible element such that said element is not radially loaded against said guide wheels at said inflection point; and (e) automatically sequencing the pipe spinner manipulation once initiated by the steps of closing jaws carrying said flexible drive element to embrace the pipe, locking said jaws together, applying tension to said flexible drive element, starting a spin drive motor, stopping the spin drive motor at a preselected torque level, unlatching said jaws, releasing tension on said flexible element, and opening said jaws to free the pipe from the spinner.

21. The method of claim 20 further providing the steps of synchronizing pipe rotation and flexible element velocity such that if slippage occurs, only a preselected rate of slippage is permitted.

22. The method of claim 20 further providing the steps of controlling flexible element tension such that there exists a preselected ratio of chain tension and torque used to circulate the flexible drive element.

* * * * *